US007421933B1

(12) United States Patent
Pearson

(10) Patent No.: US 7,421,933 B1
(45) Date of Patent: Sep. 9, 2008

(54) TELESCOPING STUN GUN

(76) Inventor: Frederick Thomas Pearson, 5007 Sawyer Rd., Signal Mountain, TN (US) 37377

( * ) Notice: Subject to any disclaimer, the term of this patent is extended or adjusted under 35 U.S.C. 154(b) by 0 days.

(21) Appl. No.: 10/613,786

(22) Filed: Jul. 3, 2003

(51) Int. Cl.
*B64D 1/04* (2006.01)
*F41F 5/00* (2006.01)

(52) U.S. Cl. ..... 89/1.11; 42/84; 361/232

(58) Field of Classification Search ..... 89/1.11, 89/1.1; 42/84, 1.08; 361/232; 231/7
See application file for complete search history.

(56) References Cited

U.S. PATENT DOCUMENTS

| | | | | | |
|---|---|---|---|---|---|
| 2,733,003 | A | * | 1/1956 | Abildgaard et al. | 231/7 |
| 2,981,465 | A | * | 4/1961 | Bartel | 231/7 |
| 3,362,711 | A | * | 1/1968 | Larsen et al. | 463/47.3 |
| 3,998,459 | A | * | 12/1976 | Henderson et al. | 463/47.3 |
| 4,084,218 | A | * | 4/1978 | Kenney | 363/18 |
| 4,092,695 | A | * | 5/1978 | Henderson et al. | 361/232 |
| 4,167,036 | A | * | 9/1979 | Kenney | 363/61 |
| 4,719,534 | A | * | 1/1988 | Ward | 361/232 |
| 4,819,137 | A | * | 4/1989 | Hamilton | 362/102 |
| 4,884,809 | A | * | 12/1989 | Rowan | 463/47.3 |
| D318,149 | S | * | 7/1991 | Young | D30/156 |
| 5,457,597 | A | * | 10/1995 | Rothschild | 361/232 |
| 6,091,597 | A | * | 7/2000 | Lin | 361/232 |
| 6,963,480 | B2 | * | 11/2005 | Eccles | 361/232 |

* cited by examiner

*Primary Examiner*—Michelle Clement
(74) *Attorney, Agent, or Firm*—Kent R. Moore

(57) ABSTRACT

An improved telescoping stun gun comprising a self-contained power source electrically connected to a voltage step-up circuit that has an output of stepped-up voltage. A first tube section is connected to a handle. One or more additional tube sections are disposed more or less concentrically within the first tube section, the smallest being the innermost tube section. The tube sections are preferably multiple sections of interlocking, concentric, thin-walled, rigid, tapered tubes. The smallest tube section includes one or more probes that are electrically connected to the output of the step-up circuit. The tube sections are configured so that if a centrifugal force, such as the flick of the wrist is applied, the inner tube sections automatically extend and lock into place forming a shaft that extends away from the handle. A probe or probes at the end of the smallest tube section are located at the distal end of the entire shaft and can be used to shock or warn a potential attacker. Conductive strips, energized by the output of the step-up circuit, may be placed along the shaft to prevent an attacker from grabbing and removing the telescoping stun gun of the present invention from the operator.

1 Claim, 3 Drawing Sheets

TELESCOPING STUN GUN

1. FIELD

The present invention relates generally to the field of personal protection devices and more particularly to an improved telescoping stun gun having a handle connected to a rapidly extendable shaft, a power unit connected to shock electrodes at the end of the shaft. The power source also may energize conductive strips along all or a portion of the length of the shaft.

2. BACKGROUND

Over the years a number of hand-held electrical shocking devices (stun guns) have been developed with varying degrees of success. One of the primary drawbacks with such devices is the close proximity that one must maintain an order to subdue an assailant. Conversely, projectile-type devices, while extending the effective "reach" of such devices (although not enough to really matter) are too cumbersome to be comfortably carried or concealed in most self-defense or law-enforcement situations. Projectile-type stunning devices (such as the "TASER") are tactically limited due to a number of practical considerations not the least of which is their "one shot" or "shallow magazine" nature which precludes their being used against multiple subjects.

The present invention represents an increase in tactical effectiveness over all other existing stun gun systems. Simple, compact and light weight, the device of the present invention enables the operator to efficiently subdue and incapacitate all but the most heavily armed opposition, irrespective of disparities in relative size, strength or reach. With the device of the present invention, one can favorably resolve a number of situations that might otherwise require the use of lethal force.

Minimal training is required to become proficient in the use of this invention and the potential civilian, law-enforcement and military applications of the present invention are numerous. The design of the present invention represents a significant breakthrough in the practical efficiency of personal non-lethal defense weapons.

3. SUMMARY

The improved telescoping stun gun of the present invention comprises a self-contained power source such as batteries, electrically connected to a voltage step-up circuit that has an output of stepped-up voltage relative to the power source as in conventional commercially available stun-guns (such as Muscle Man, Omega, Stun Master and Taser). The power source and step-up circuitry are preferably contained in an ergonomically shaped handle for easy and sure gripping. A first tube section is connected to the handle. One or more additional tube sections are disposed more or less concentrically within the first tube section, the smallest being the innermost tube section. The tube sections are preferably multiple sections of interlocking, concentric, thin-walled, rigid, tapered tubes. The tube sections, if placed end to end, form a tapered shaft, tapering from largest near the handle to smallest at the distal end. The smallest tube section includes one or more probes that are electrically connected to the output of the step-up circuit. The tube sections are configured so that if a centrifugal force, such as the flick of the wrist, or other deployment means is applied, the inner tube sections automatically extend and lock into place by a connection means forming a shaft that extends away from the handle. The probe or probes at the end of the smallest tube section are located at the distal end of the entire shaft and can be used to intimidate, shock or warn a potential attacker. Conductive strips, energized by the output of the step-up circuit, may be placed along the shaft to prevent an attacker from grabbing and removing the telescoping stun gun of the present invention from the operator.

The present invention is a vast improvement over conventional stun gun/baton designs. The present invention greatly increases the effectiveness of a high voltage stun gun while maintaining a compact and light weight package when not in use. One of the important features of the present invention is the speed with which it can be deployed, quite literally in the blink of an eye. The almost instantaneous deployment along with anti-grab conductive leads that run along the shaft, make this device difficult to defend oneself from.

The present invention provides increased safety for the operator in greatly extending his or her secure defensive radius as well as the tactical sphere of direct influence. A flick of the wrist instantly deploys the tube sections to form a fully extended shaft having one or more probes or electrodes at the end of the shaft. The probes may extend from the end of the shaft. In an alternate embodiment, the conductive leads may extend to the end of the shaft to serve as the shock delivering electrodes. The rotational energy imparted to the inner (distal when extended) tube sections causes them to snap out and lock in place instantly. The exposed conductive leads along the shaft prevent the operator from being disarmed by an assailant. By grasping the shaft of the present device, an attacker merely facilitates the delivery of the high voltage charge and must either immediately let go of the instrument or be quickly incapacitated. The operator can expand and retract the shaft any number of times to target different specific body areas on one or more assailants.

In an alternate embodiment, the power unit housing may form the handle of the device and be disposed within the extendable shaft at the base of the largest diameter tube section. The electrode probes are mounted on the narrow end of the smallest diameter (center when retracted) tube section. Wires connecting the power unit to the electrodes must be capable of spanning the entire distance of the extended shaft.

In a preferred embodiment, the present invention is equipped with a retention device to help maintain the retracted position when not in use. When the improved stun gun of the present invention is in the retracted position, the smaller tube sections rest inside one another according to their respective sizes. They are held in the retracted positions inside the largest (base) tube section by any number of retentions means, including, but not limited to, Velcro, internal or external clips, straps, O-rings, or caps. The electrode probes can then be deployed inertially, almost instantly, with the flick of the wrist. In the blink of an eye, the shaft can achieve full extension and lock into place via friction delivering a high voltage charge to a subject before any meaningful reaction can occur. The operator can engage multiple consecutive attackers or discourage further aggression with a display of high voltage arcing from the electrode probes or from the shaft itself. The unit can fire in either the retracted or extended positions.

Anti-grab conductive leads consisting of wires, conductive strips, metallic tape, or similar conductive material attached to or embedded in and running along the outside of the shaft prevent the weapon of the present invention from being taken away from the operator. This feature, along with the extreme speed of deployment make effective response to this device very difficult. Deployment itself is essentially frictionless until full extension is reached and the sections lock in place via friction. The smallest diameter end of each tapered tube section captures the largest diameter and of the neighboring (consecutively smaller diameter) tube section, effectively locking up the entire extended shaft. This extremely rapid deployment allows the operator to selectively and accurately administer a high voltage electrical charge from well beyond arm's length and target specific body areas at their discretion.

Light weight, compact, reliable and extremely effective, the improved stun gun of the present invention enables anyone to quickly subdue and incapacitate all but the most heavily armed opposition, irrespective of disparities in relative size, strength or reach. The present invention also allows the operator to favorably resolve a wide variety of situations that might otherwise require the use of lethal force. The potential applications of the present invention to law enforcement, civilian use (such as animal control) and self defense are virtually unlimited.

Other objects, advantages and capabilities of the present invention will become more apparent as the description proceeds, taken in conjunction with accompanying drawings, in which like parts have similar reference numerals.

4. BRIEF DESCRIPTION OF THE DRAWINGS

5. DETAILED DESCRIPTION

Figure 1:
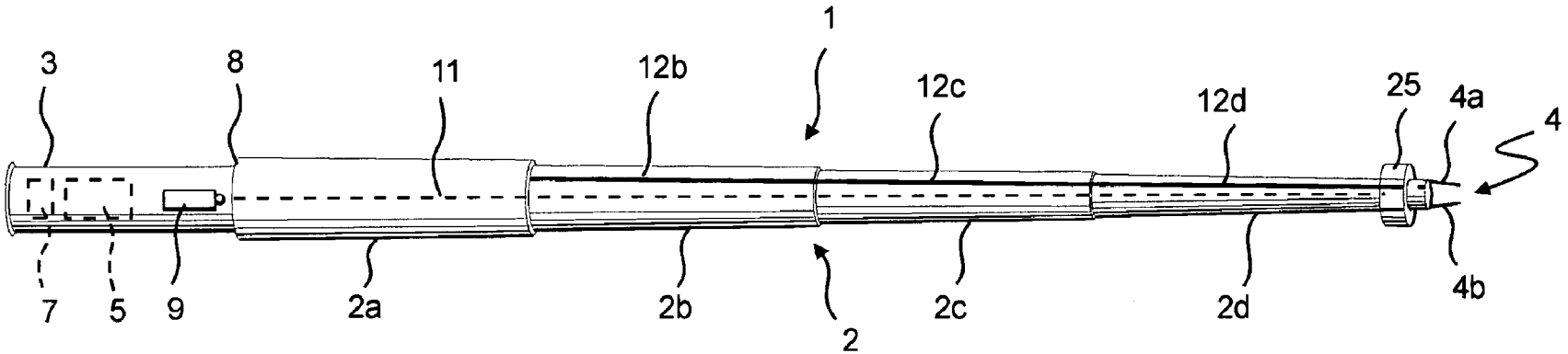
FIG. 1 shows an improved telescoping stun gun of the present invention in an extended position.
Figure 2:
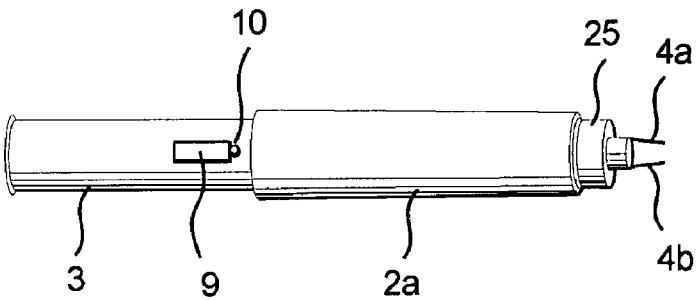
FIG. 2 illustrates the improved telescoping stun gun of the present invention shown in FIG. 1 in a retracted position.
Figure 3:
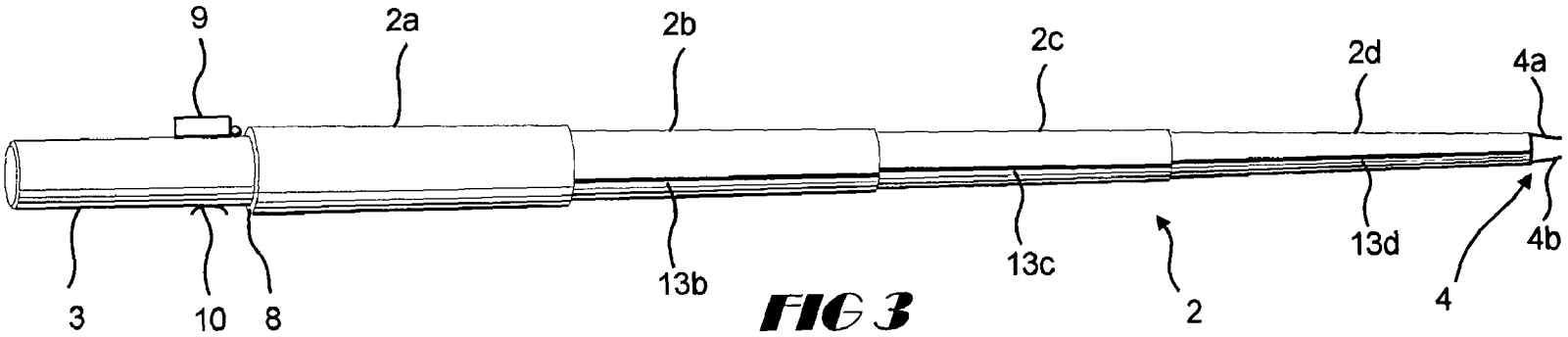
FIG. 3 illustrates an alternate embodiment of the improved telescoping stun gun of the present invention in an extended position.

Referring to FIGS. 1-3, a preferred embodiment of the present invention 1 comprises an extendable shaft 2 connected at one end of the extendable shaft 2 to a handle 3. An opposite end of the extendable shaft 2 includes one or more electrical probes 4 for delivering a high-voltage charge to an attacker. The handle 3 houses a voltage step-up circuit 5 electrically connected to batteries or other power source 7 to provide a high voltage output relative to the power source 7. The output of the step-up circuit is electrically connected to the one or more probes 4. This circuitry is similar to those used in stun-guns and need not be discussed herein in detail. Preferably, the step-up circuit 5 and power source 7 can be arranged to fit into an ergonomic handle 3 for ease of gripping and use. In an alternate embodiment, discussed herein, step-up circuit 5 and power source 7 can be disposed in other portions of the present invention 1 eliminating the need for a separate handle 3. It should further be noted that virtually any type of device capable of delivering an electrical charge, existing or the product of future development, might be adapted for use in the present invention 1.

The extendable shaft 2 preferably is comprised of a series of rigid, concentric, tubes sections, first tube section 2*a*, second tube section 2*b*, third tube sections 2*c* and fourth tube section 2*d*. First tube section 2*a* is preferably connected at its base 8 to the handle 3. Preferably, each tube section is tapered so that the interior diameter of the distal end (relative to the handle 3) of first tube section 2*a* is slightly smaller than the exterior diameter of the proximal end of second tube section 2*b* and so forth to form a connection means for connecting the tube sections. Although four tube sections are shown in the preferred embodiment, as few as two tube sections may be used in order to create an extendable shaft 2. Moreover, the tube sections need not have a taper over the entire length of each respective section. Rather a taper at or near each end of each tube section would suffice.

The tapered tube sections 2*a*, 2*b*, 2*c*, and 2*d* may be made of any suitable material including, but not limited to, wound filament fiberglass, PVC, high impact plastic, polycarbonates, or composites. With the proper electrical insulation, materials such as aluminum, carbon fiber, brass, copper, and other electrically conductive materials may be used. The tube sections 2*a*, 2*b*, 2*c*, and 2*d* fit loosely inside each other according to their respective sizes with 2*a* being the outermost section. The tube sections 2*b*, 2*c*, and 2*d* can be instantly deployed with any suitable deployment means such as a spring and trigger mechanism, C02 power, or compressed air. However, the preferred means of deployment, and an important feature of the present invention 1 is to use centrifugal force with a flick of the wrist. Extension is essentially frictionless until full deployment is almost reached and the tube sections 2*b*, 2*c*, and 2*d* lock into place by the friction encountered from the snug fit caused by the taper of the tube sections 2*a*, 2*b*, 2*c*, and 2*d* Prior devices have contained too many components, causing the prior devices to be too heavy to carry for self-defense purposes. Excessive components in prior devices also have created problems with maintenance in the event one of the numerous components happens to break or fail.

It should be noted that the number of tube sections may vary widely as can the degree of taper used for each tube section. The preferable taper for the tube sections is one inch in diameter for three feet of length. Tube sections can be of such dimension that if placed end-to-end, largest to smallest, the ends of each with line up with that of its neighbor. In other words, the tube sections could be cut from the stock from a single mandrel. Many variations in the number, length, thickness, diameter, cross-sectional shape, size and taper of the tube sections can be used and still work properly and effectively.

The inner (when retracted) tube sections 2*b*, 2*c* and 2*d* of the shaft 2 may be retained in the first tube section 2*a* by any number of retention means to prevent accidental deployment. The retention means include, but are not limited to, an end cap 25 that is attached at or near the distal end of tube section 2*d* and sized so that it fits snugly within tube section 2*a*, but not tight enough to prevent deployment. It should be apparent to anyone still any art that any number of systems can be employed for preventing accidental deployment including, but not limited to, O-rings, spacers, magnets, Velcro, clips, tapered plugs, or straps. The end cap 25 also may be eliminated completely allowing the shaft sections to float freely.

Preferably, the distal end of the tube section 2*d* contains probes 4*a* and 4*b* for delivering a shock to an assailant. The probes 4*a*, 4*b* are electrically connected to the output of the step-up circuit 5 preferably by internal wiring 11. The wiring 11 can be coiled, placed in a spring loaded spool, or remaining loose depending on many variables such as the length of the overall extendable shaft 2. The wiring 11 must be of sufficient length to span the entire distance of the shaft 2 when the device of the present invention 1 is deployed. The probes 4*a* and 4*b* may be arranged in any number of configurations which may be useful for various self-defense purposes. For example, the probes may be parallel or be tilted toward or away from each other. In certain configurations, the probes may visibly display the arcing for intimidation purposes or for a warning. In other configurations, the visible arcing may be eliminated. The probes also may be sharpened to facilitate the penetration of heavy clothing.

Conductive leads 12*b*, 12*c*, and 12*d* and 13*b*, 13*c* and 13*d*, may be attached to or embedded along the tube sections 2*b*, 2*c*, 2*d*. The conductive leads are arranged so that the conductive leads at the distal end of tube section 2*b* electrically connect to the conductive leads at the proximal end of tube section 2*c* and so on. Direct connection is not crucial as the high voltage delivered by the present invention 1 can easily jump gaps. The conductive leads all are electrically connected to the output of the step-up circuit 5 either directly or indirectly through a connection to the probes 4*a*, 4*b*. The conductive leads are comprised of an exposed metal or other electrically conductive strip that acts as an anti-grab mechanism. The conductive leads deliver a high voltage shock to anyone who attempts to grab the shaft 2 of the present invention 1. The number and arrangement of conductive leads can vary. For example, the conductive leads may be arranged around the shaft spirally, in a criss-cross pattern or in any other pattern to facilitate and effect of delivery of a high voltage shock to anyone attempting to grab the shaft 2 of the present invention 1.

An on/off switch 9 and trigger 10 can be mounted in any convenient position on the handle 3. However, the switch 9 and trigger 10 are preferably mounted either together or on opposing sides of handle 3. In a preferred embodiment, the on/off switch 9 arms the present invention 1 and must be turned on to achieve the stepped-up voltage at the output of the step-up circuit 5. The trigger 10 is depressed by a user to send the high voltage to the one or more probes 4 that are electrically connected to the output of the step-up circuit 5 and the conductive leads.

Figure 4:
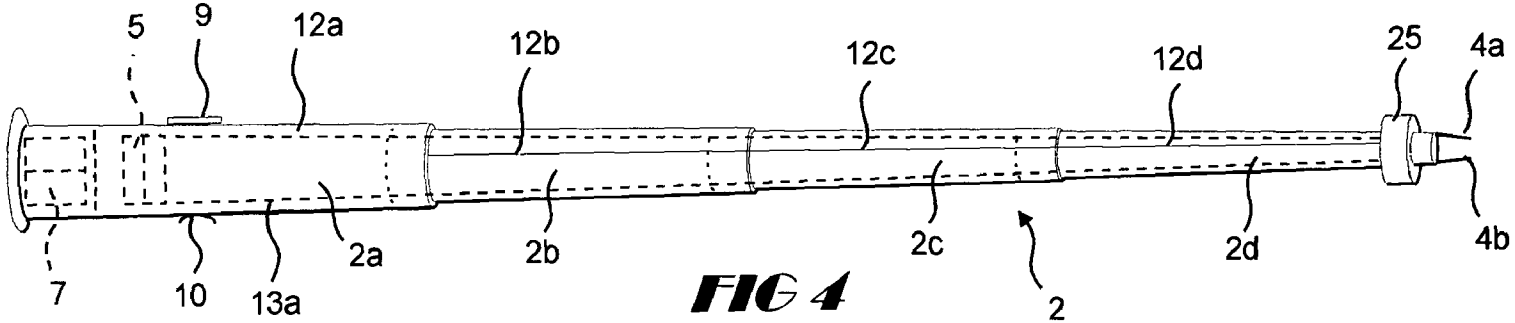
FIG. 4 illustrates an alternate embodiment of the improved telescoping stun gun of the present invention in an extended position.
Figure 5:
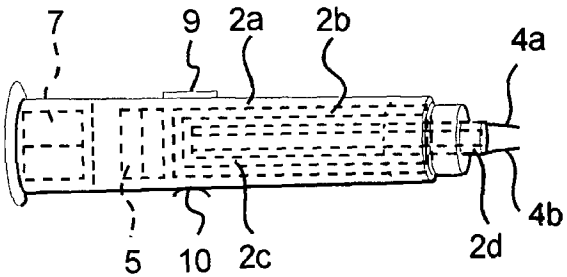
FIG. 5 illustrates the improved telescoping stun gun of the present invention shown in FIG. 4 in a retracted position.

FIGS. 4 and 5 illustrate an alternate preferred embodiment of the present invention 1. In this embodiment, the handle 3 is eliminated. The step-up circuit 5 and batteries 7 are disposed within and near the base 8 of the first tube section 2*a* to allow the additional tube sections 2*b*, 2*c*, and 2*d* to be contained within the first tube section 2*a* when in the retracted position. The switch 9 and trigger 10 are mounted on the side of the tube section 2*a*. The tube section 2*a* effectively serves as the handle in this alternate preferred embodiment of the present invention 1.

In a particularly preferred embodiment, the internal wires 11 may be eliminated to create a "wireless" extendable stun gun 1 of the present invention. In this configuration, one or more of the conductive leads 12*a*, 13*a* may be directly electrically connected to the output of the step-up circuit 5. At the distal end of the shaft 2, the conductive leads 12*d*, 13*d* are connected to the probes 4*a*, 4*b*. Therefore, once the shaft 2 is fully extended, and the conductive lead 12*a* is electrically connected to 12*b* and so on, the probes 4*a* and 4*b* are "hot" when activated by the switch 9 and trigger 10. To insure a consistent electrical connection through the entire length of shaft 2 to the probes, it is preferable to use four or more conductive leads per tube section. In an alternate embodiment of the preferred "wireless" stun gun, the step-up circuit 5 and power source 7 are located in the tube section 2*d* and wired directly to the probes. The circuitry may be switched and triggered using any known means.

Figure 7:
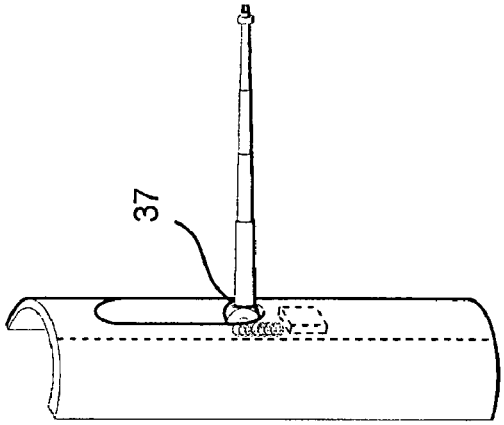
FIG. 7 illustrates a side view of a preferred embodiment of the improved telescoping stun gun of the present invention attached to a riot shield in an extended position.
Figure 6:
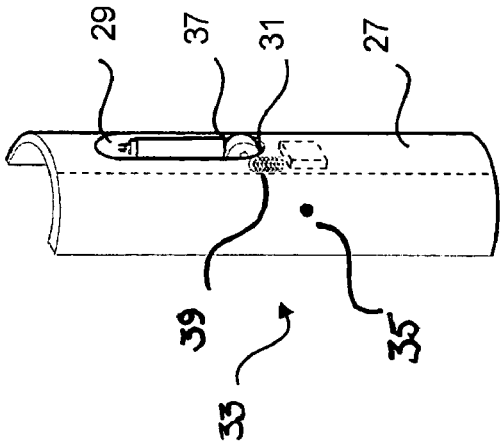
FIG. 6 illustrates a side view a preferred embodiment of the improved telescoping stun gun of the present invention attached to a riot shield and in a retracted position.

FIGS. 6 and 7 illustrate a second alternative preferred embodiment of the present invention 1. In this embodiment, the improved telescoping stun gun of the present invention is mounted to a riot shield 27. Preferably, the improved telescoping stun gun of the present invention 1 is rotatably mounted to the riot shield 27. The riot shield 27 also preferably contains a recessed pocket 29 which serves as a cradle for the stun gun of the present invention 1 in its fully retracted position as shown in FIG. 6. The base 8 of the first section 2*a* is attached at the lower portion 31 of the pocket 29. Any number of configurations may be used to rotatably attach the stun gun of the present invention 1 to the lower portion 31 of the pocket 29. For example, the stun gun of the present invention 1 may be attached to the lower portion 31 of the riot shield 27 by an axle or with ball and socket arrangement.

In a particularly preferred embodiment, a coiled spring 37 is connected both to the lower portion 31 of the riot shield 27 and the base 8 of the first tube section 2*a*. The spring 37 is attached so that the spring 37 is exerting pressure when on the base 8 of the first tube section 2*a* when in the retracted position. A locking mechanism 39 maintains the stun gun 1 in its retracted position until the operator is ready to deploy the stun gun 1. Preferably, the batteries 7 and step-up circuit 5 are attached on the operator side 33 of the riot shield 27. The power switch 9 and trigger 10 along with the release buttons 35 are attached to the handles of the shield for easy access by the operator. By depressing a release button 35, the spring 37 forces the stun gun 1 to rotate downward and at the same time imparts sufficient centrifugal force to cause the tube sections 2*b*, 2*c*, and 2*d* of the stun gun 1 to deploy and lock into place a shown in FIG. 7. The operator can arm and use the stun gun of the present invention by means of on/off switch 9, and fire trigger 10. The electrical circuitry of the stun gun of the present invention 1 may be configured so that the shaft is instantly charged when deployed with no further action on the part of the operator.

Figure 8:
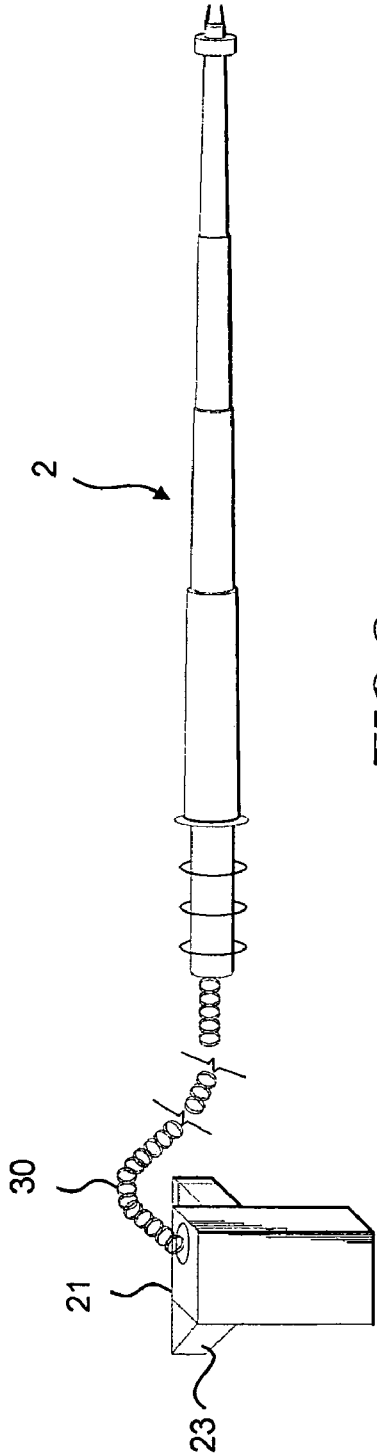
FIG. 8 illustrates an alternate embodiment of the improved telescoping stun gun of the present invention.

In an alternate preferred embodiment of the present invention 1, FIG. 8 illustrates a power unit 21, comprising a step-up circuit 5 and the batteries 7, as detached from the extendable shaft 2. In this configuration, the operator may carry the power unit 21 on a belt pack 23, back pack or similar arrangement. Wires 30 connect the power unit 21 to the stun gun of the present invention 1. This configuration allows the stun gun of the present invention to have a larger power source 21 to deliver a larger voltage or amperage and also gives the power unit an extended charge life.

It should be appreciated that the illustrated and described embodiments are examples and not limitations on the present invention. The variations and other embodiments are defined by the scope of the following claims.

I claim:

1. An improved telescoping stun gun comprising:

a. a first tube section made from non-conductive material and having a base section and a distal end, said first tube section having no keys, said first tube section comprising a power source electrically connected to a voltage step-up circuit having an output of stepped-up voltage relative to the power source, said first tube section having an inner wall, the first tube section being tapered along its entire length, said taper being the widest at the base section and the smallest at the distal end of the first tube section;

b. at least one additional tube section made from non-conductive material and having a proximal end and a distal end and being disposed within the first tube section, said at least on additional tube section having no keys, the additional tube section being smoothly tapered along its entire length, said taper being the widest at the proximal end and the smallest at the distal end of the additional tube section, said distal end comprising a conductive probe electrically connected to the output of the step-up circuit, said probe for delivering a high-voltage shock, said proximal end of said at least one additional tube section having an outer wall that is larger than the inner wall of the distal end of the first tube section;

c. deployment means to extend said at least one additional tube section from its position as being disposed within the first tube section to an extended position whereby, when in the extended position, the outer wall of the at least one additional tube section directly contacts the inner wall of the distal end of the first tube section, the direct contact between the outer wall the at least one additional tube section and the inner wall of the first tube section causing a frictional connection which locks the additional tube section in its extended position;

d. at least two first conductive leads electrically connected to the probe, said first conductive leads attached to the outside of the at least one additional tube section; and e. at least two second conductive leads electrically connected to the conductive probe, said second conductive leads being placed along a portion of the length of the exterior of the first tube section; whereby the electrical connection between the at least two first conductive leads and the probe and the two second conductive leads and the probe allows the two first conductive leads and the two second conductive leads to transfer the high voltage to the probe independently of the orientation of the first tube section having no keys and additional tube section having no keys when in the extended position.

* * * * *